US011499334B2

(12) United States Patent
Baik et al.

(10) Patent No.: US 11,499,334 B2
(45) Date of Patent: Nov. 15, 2022

(54) POLE FRAME STRUCTURE OF FOLDABLE TENT

(71) Applicant: LUHUA (XIAMEN) TRADING CO., LTD., Fujian (CN)

(72) Inventors: Kwang ho Baik, Seoul (KR); Renhua Chen, Xiamen (CN)

(73) Assignee: Campvalley (Xiamen) Co., Ltd., Fujian (CN)

( * ) Notice: Subject to any disclaimer, the term of this patent is extended or adjusted under 35 U.S.C. 154(b) by 0 days.

(21) Appl. No.: 17/262,205

(22) PCT Filed: Apr. 3, 2019

(86) PCT No.: PCT/CN2019/081201
§ 371 (c)(1),
(2) Date: Jan. 22, 2021

(87) PCT Pub. No.: WO2020/103375
PCT Pub. Date: May 28, 2020

(65) Prior Publication Data

US 2021/0301551 A1 Sep. 30, 2021

(30) Foreign Application Priority Data

Nov. 22, 2018 (CN) ..... 201811398380.3

(51) Int. Cl.
*E04H 15/50* (2006.01)
*E04H 15/46* (2006.01)

(52) U.S. Cl.
CPC ..... *E04H 15/50* (2013.01); *E04H 15/46* (2013.01)

(58) Field of Classification Search
CPC ..... E04H 15/50
See application file for complete search history.

(56) References Cited

U.S. PATENT DOCUMENTS 4,558,713 A * 12/1985 Hagler ..... E04H 15/34 135/120.3
8,220,477 B2 * 7/2012 Park ..... E04H 15/50 135/145
11,299,906 B2 * 4/2022 Yang ..... E04H 15/60
(Continued)

FOREIGN PATENT DOCUMENTS

CN 203230225 U * 10/2013 ..... E04H 15/50
DE 202015101958 U1 * 5/2015 ..... E04H 15/44
(Continued)

*Primary Examiner* — David R Dunn
*Assistant Examiner* — Danielle Jackson
(74) *Attorney, Agent, or Firm* — Leong C. Lei

(57) ABSTRACT

An improved pole frame structure of a foldable tent includes upright poles, side cross support rod assemblies, and a top support rod unit. The top support rod unit includes a top module provided with a limiting component, top support rod assemblies, and oblique support rods. One end of each oblique support rod is connected to the respective top support rod assembly by means of a slider provided with a stopper, and the other end of the oblique support rod is pivotally connected to the respective side cross support rod assembly. The structure enhances, by means of the stopper and the limiting component, the stability of the oblique support rods supporting tent cloth, and prevents the tent cloth from being damaged by the oblique support rods.

7 Claims, 8 Drawing Sheets

(56) References Cited

U.S. PATENT DOCUMENTS

| | | | | |
|---|---|---|---|---|
| 2005/0055892 | A1* | 3/2005 | Tsai | E04H 15/50 52/79.1 |
| 2005/0247335 | A1* | 11/2005 | Wu | E04H 15/50 135/121 |
| 2009/0032079 | A1* | 2/2009 | Choi | E04H 15/50 135/144 |
| 2011/0061702 | A1* | 3/2011 | Lin | E04H 15/50 135/145 |
| 2019/0277053 | A1* | 9/2019 | Yang | E04H 15/58 |

FOREIGN PATENT DOCUMENTS

| | | | | |
|---|---|---|---|---|
| JP | 2005290837 | A * | 10/2005 | |
| JP | 2018135685 | A * | 8/2018 | |
| WO | WO-2014139284 | A1 * | 9/2014 | E04H 15/50 |

* cited by examiner

POLE FRAME STRUCTURE OF FOLDABLE TENT

BACKGROUND OF THE INVENTION

1. Field of the Invention

The present invention relates to a tent frame, and more particularly to an improved pole frame structure of a foldable tent.

2. Description of the Prior Art

A tent generally includes a piece of tent cloth and a tent frame. The tent cloth is fixedly installed on the top of the tent frame, so that a sheltered use space is formed under the support of the tent frame. Because of the practicability of the tent, it is widely used in various temporary places.

Besides, in order to make the tent convenient to carry and have a large sheltered use space, the structure of the tent frame often makes the tent have the functions of folding and unfolding. A common rectangular tent frame includes four upright poles. A side cross rod unit is provided between every adjacent two of the upright poles. The top of the tent frame is provided with a top support rod unit. The top support rod unit includes four top support rod assemblies distributed radially. One end of each top support rod assembly, facing the center of the tent, is pivotally connected to a pivot seat in the middle of the tent, and the other end of each top support rod assembly is connected to the top of a corresponding one of the upright poles. The top support rod assembly includes two connecting rods that are pivotally connected to each other. The junction of the two connecting rods is provided with a connecting member. Two ends of the connecting member can support the connecting rods on both sides thereof when the tent is unfolded. When the upright poles of the tent are unfolded, the top support rod unit can support the tent cloth at the top end to form a large tent with a larger shelter area.

In order to make the top support rod assembly have a strong support for the tent cloth, the top support rod assembly further includes an oblique support rod. Two ends of the oblique support rod are pivotally connected to the top support rod assembly and the side cross rod unit, which will not affect the folding and unfolding of the tent and can provide strong support for the top support rod assembly. However, when in use, one end of the oblique support rod, pivoted to the top support rod assembly, will rotate about the pivot axis. In a windy situation, the tent cloth may sway up and down. The oblique support rod pivotally connected to the top support rod assembly cannot provide a firm support. In addition, the oblique support rod will be higher than the top support rod assembly after rotating about the pivot axis, and will prop up the tent cloth with a raised portion. When the tent cloth is swayed up and down, the end of the oblique support rod, facing the tent cloth, will rub the tent cloth repeatedly. After long-term use, the rubbed part of the tent cloth will be damaged due to aging, or it will be directly damaged by the oblique support rod.

In addition, when in use, it was found that the support effect of the connecting member on the connecting rod close to one side of the pivot seat is only effective at its end. The other connecting rod that also supports the end is completely enough to support it. Therefore, the connecting member not only increases the production cost of the tent but also makes the assembly of the tent cumbersome and time-consuming.

In addition, the connection between the pivot seat at the center of the tent and the top support rod assemblies is still unstable. The pivot seat may drive each top support rod assembly to sway up and down in the center of the tent frame, which will easily cause the top support rod assemblies to sag in the center of the tent. As a result, the tent cloth secured on the top of the tent frame sags, affecting the normal use of the tent. Especially when it is rainy, rainwater will inevitably accumulate in the sag area of the tent cloth and cannot be discharged to the surroundings, which will seriously affect the normal use of the tent and even cause the tent to collapse. For such a tent with a supporting structure on its top, the top support rod assemblies do not have sufficient support when in use.

Accordingly, the inventor of the present invention has devoted himself based on his many years of practical experiences to solve these problems.

SUMMARY OF THE INVENTION

In view of the defects of the prior art, the primary object of the present invention is to provide an improved pole frame structure of a foldable tent, which can enhance the supporting force of the top of the tent, so that the support rods on the top of the tent can be supported more stably in use to prevent the tent cloth from being damaged by oblique support rods.

In order to achieve the above object, the present invention adopts the following technical solutions:

An improved pole frame structure of a foldable tent comprises at least three upright poles and a top support rod unit connected to the upright poles. At least two side cross support rod assemblies are pivotally connected between every adjacent two of the upright poles. The side cross support rod assemblies are movably connected and positioned on the upright poles. The top support rod unit includes a top module, a plurality of top support rod assemblies, and oblique support rods. Each top support rod assembly has one end connected to an upper end of a corresponding one of the upright poles and another end movably connected to the top module. One end of each oblique support rod is pivotally connected to a corresponding one of the top support rod assemblies through a slider that is sleeved on the corresponding top support rod assembly. Another end of each oblique support rod is pivotally connected to a corresponding one of the side cross support rod assemblies located on either side of the corresponding top support rod assembly. A stopper is provided on the slider. The stopper is arranged in cooperation with a corresponding one of the oblique support rods and is located on one side of the corresponding oblique support rod facing a top of the tent. One end of the top module, facing the top support rod assemblies, is provided with a limiting component. An upper end face of each top support rod assembly abuts against a lower end face of the limiting component after the pole frame structure is unfolded.

The limiting component is integrally formed with the top module.

The stopper is obliquely arranged on the slider.

The stopper is integrally formed with the slider.

An auxiliary support rod is provided under each top support rod assembly for supporting each top support rod assembly. An upper end of the auxiliary support rod is pivotally connected to a connecting rod of each top support rod assembly, and a lower end of the auxiliary support rod is pivotally connected to a lower connecting block.

The auxiliary support rod is provided with a connecting component. One end of the connecting component is fixedly connected to the corresponding top support rod assembly, and another end of the connecting component is pivotally connected to the auxiliary support rod.

The auxiliary support rod is provided with a connecting component. One end of the connecting component is connected to the corresponding top support rod assembly in a sliding manner, and another end of the connecting component is pivotally connected to the auxiliary support rod.

By adopting the aforementioned technical solutions, in the present invention a stopper is provided on the slider.

When the tent is unfolded for use, one end of the oblique support rod, facing the top support rod assembly, is blocked by the stopper. The oblique support rod will abut against the stopper to prevent the end of the oblique support rod pivoted with the top support rod assembly from excessively rotating about the pivot axis to cause the top support rod assembly to sag. As a result, the support height of the oblique support rod to the top support rod assembly is also increased, so that the top of the tent is fully extended, and the tent cloth on the top of the tent is further supported and expanded. The tent cloth is less likely to cause problems such as sag or accumulation of water.

Furthermore, the stopper is configured to restrict the oblique support rod pivotally connected to the top support rod assembly. The oblique support rod is secured under the stopper to prevent it from rotating, which makes the support function of the oblique support rod pivotally connected to the top support rod assembly firmer, so as to solve the problem that because the oblique support rod is supported on one end of the top support rod assembly, it will rotate toward one side of the stopper. In a windy situation, the tent cloth may sway up and down due to this rotation, so that the oblique support rod pivotally connected to the top support rod assembly cannot provide a firm support. In addition, the oblique support rod will be higher than the top support rod assembly after rotating about the pivot axis, and will prop up the tent cloth with a raised portion. When the tent cloth is swayed up and down, the end of the oblique support rod, facing the tent cloth, will rub the tent cloth repeatedly. After long-term use, the rubbed part of the tent cloth will be damaged due to aging, or it will be directly damaged by the oblique support rod.

Furthermore, one end of the top module, facing the top support rod assembly, is provided with a limiting component. The upper end face of the top support rod assembly abuts against the lower end face of the limiting component after the pole frame structure of the tent is unfolded. The limiting component is configured to restrict the rotation of the connecting rod, so that the end of each top support rod assembly close to the center of the tent cannot be deformed downward, thereby enhancing the support of the top of the tent. This makes the support rods on the top of the tent more stable in use, and can prevent the top of the tent from sagging. Further, when the tent cloth is supported and expanded, the tent cloth is less likely to cause problems such as sag or accumulation of water. This increases the beauty of the tent and improves the service life of the tent.

DETAILED DESCRIPTION OF THE PREFERRED EMBODIMENTS

Embodiments of the present invention will now be described, by way of example only, with reference to the accompanying drawings.

Figure 1:
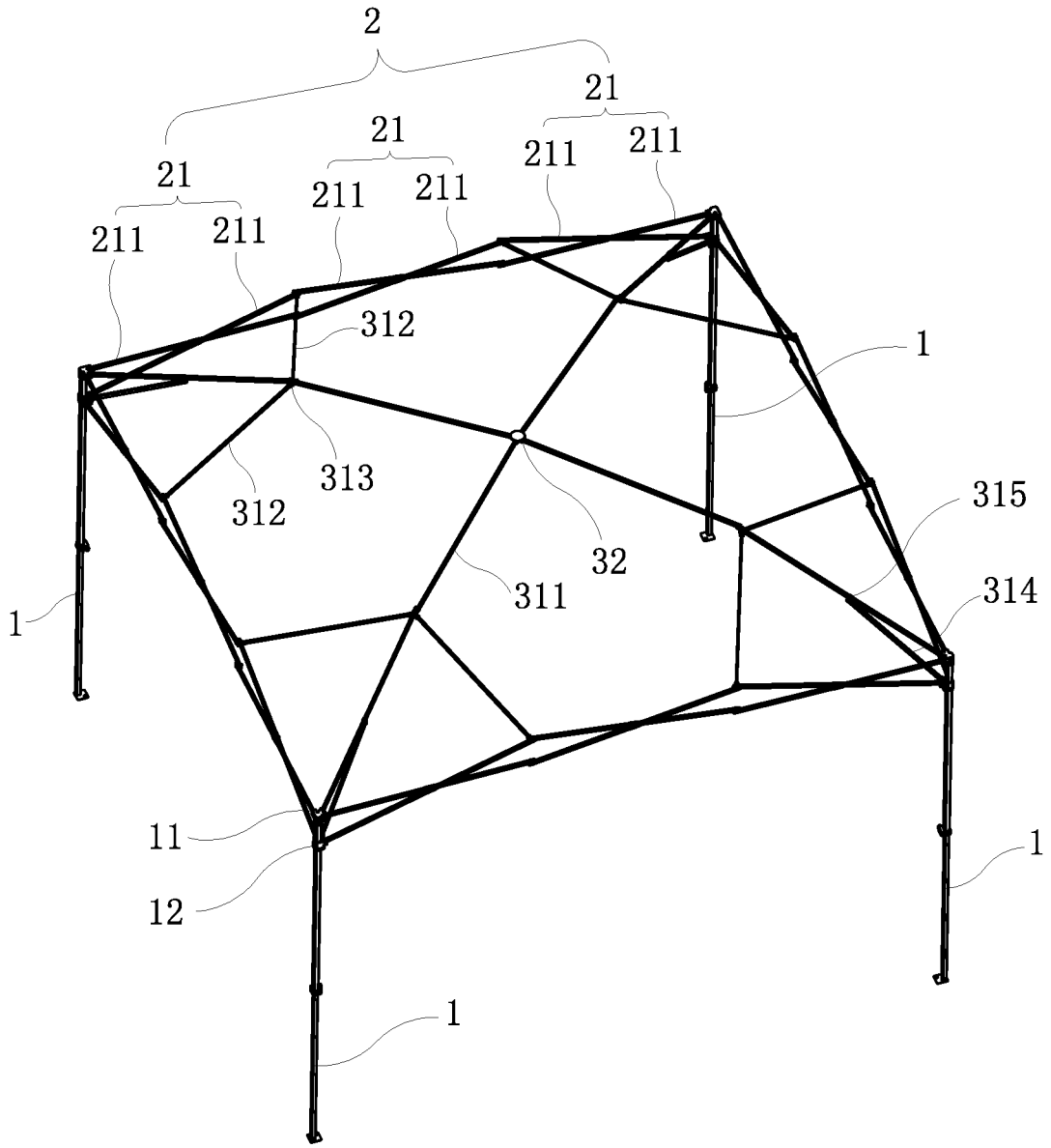
FIG. 1 is a perspective view according to a preferred embodiment of the present invention after being unfolded.
Figure 2:
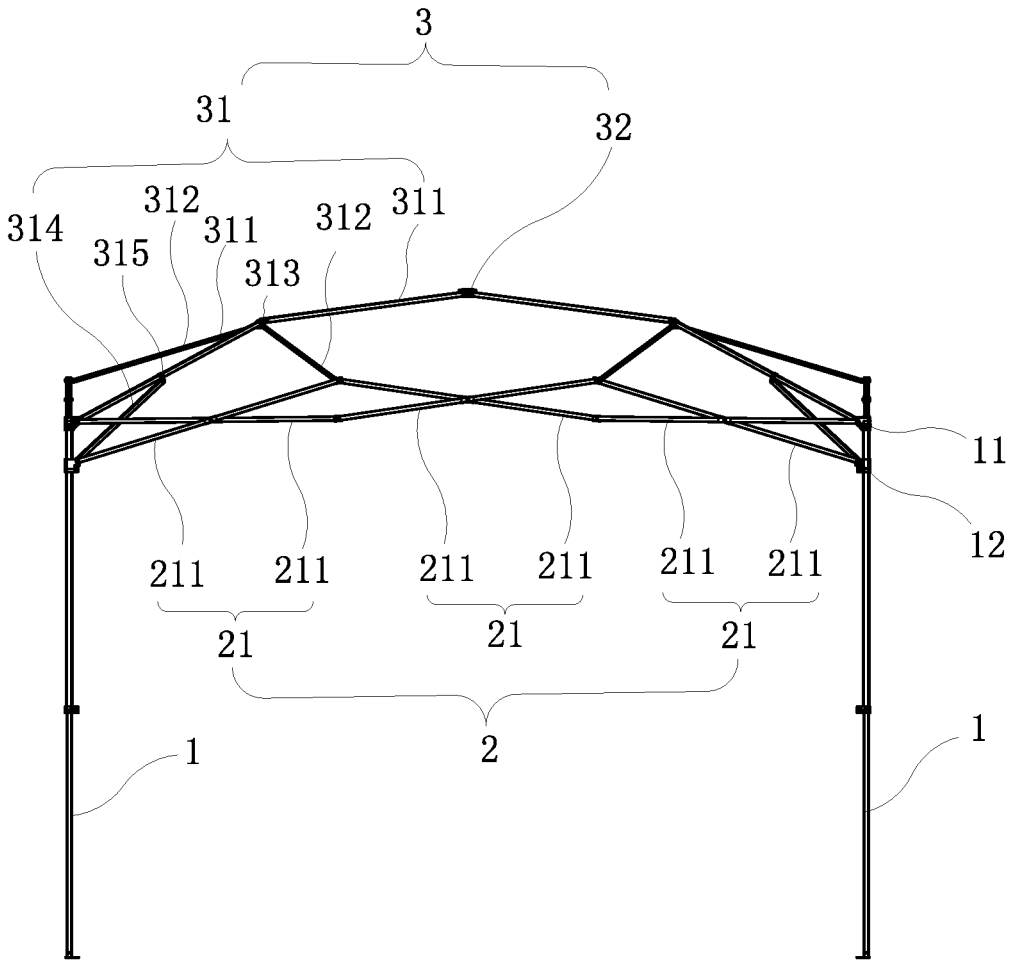
FIG. 2 is a front view according to the preferred embodiment of the present invention after being unfolded.
Figure 3:
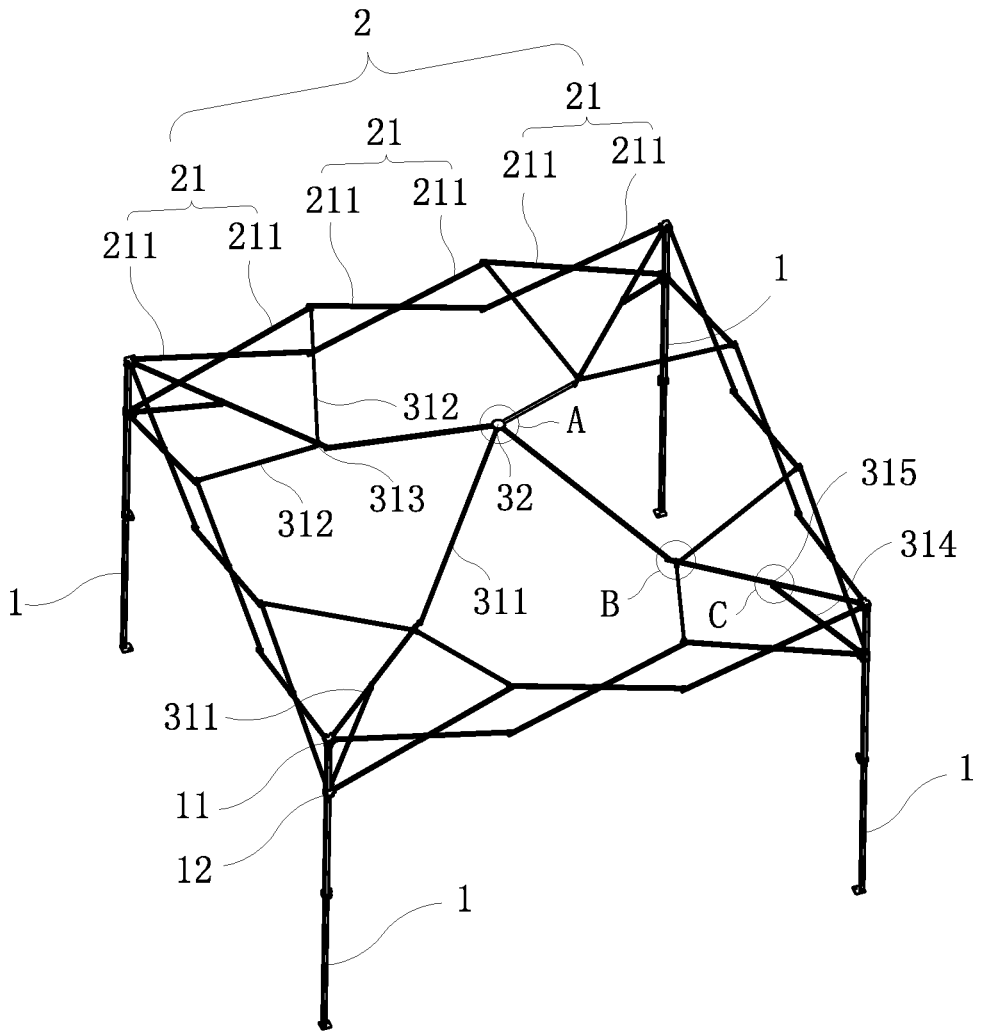
FIG. 3 is a schematic view of the preferred embodiment of the present invention in the folding process.
Figure 4:
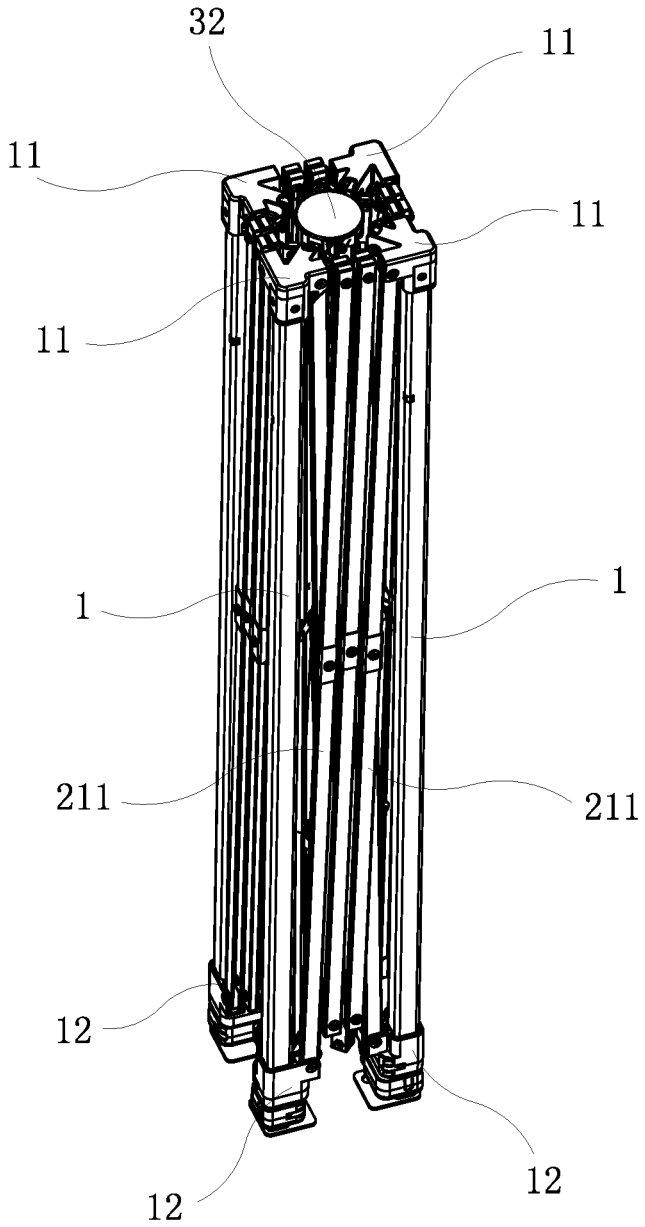
FIG. 4 is a schematic view according to the preferred embodiment of the present invention after being folded.
Figure 5:
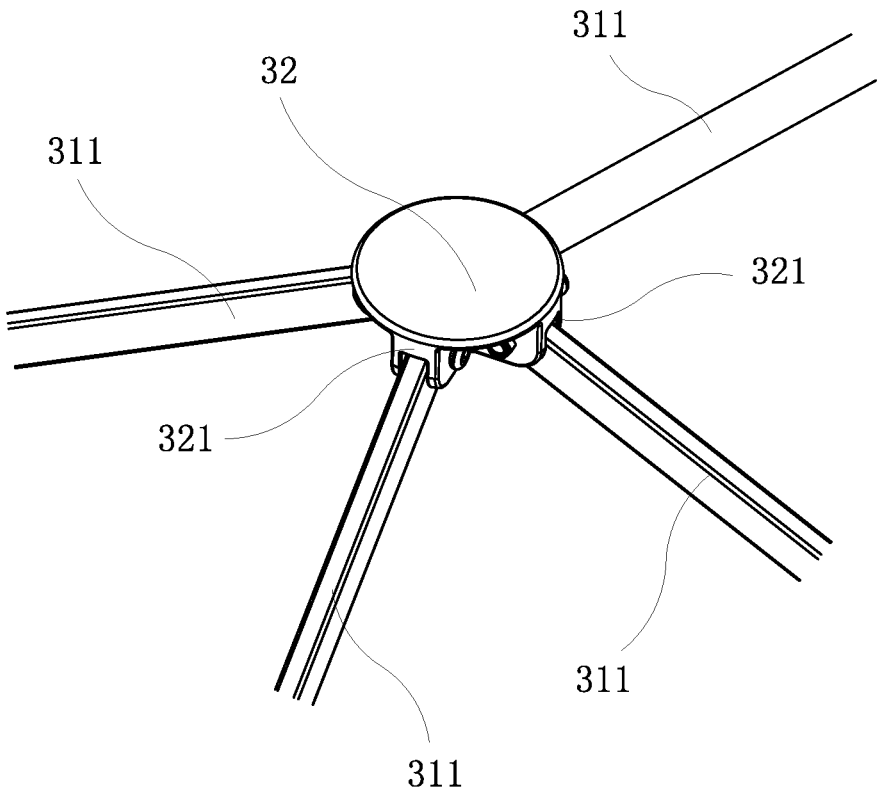
FIG. 5 is a partial enlarged view of circle A in FIG. 3.
Figure 6:
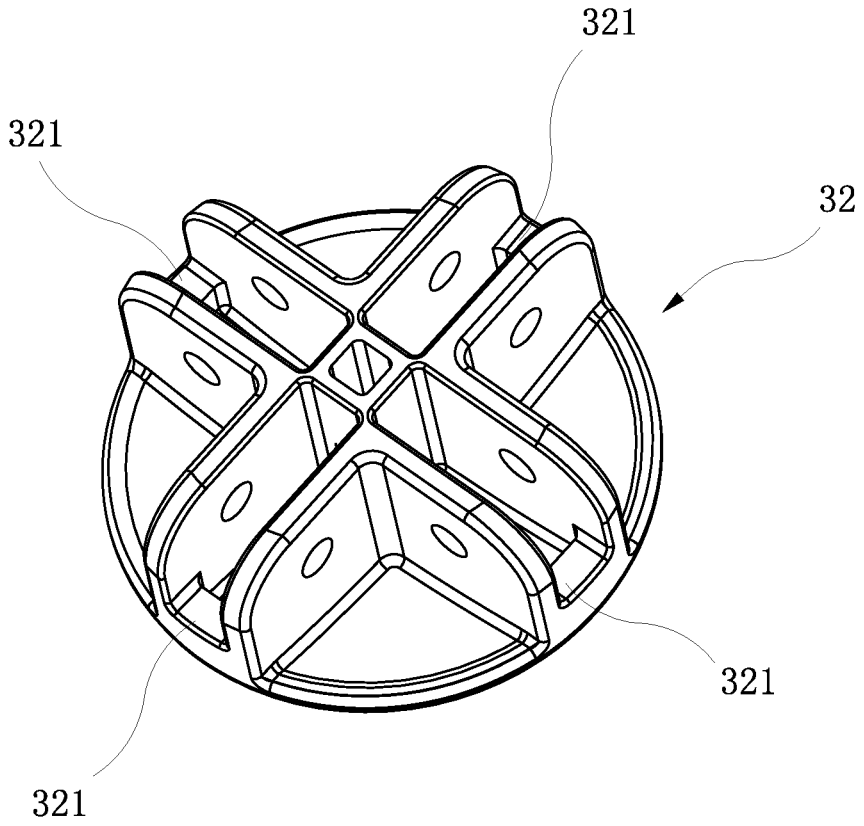
FIG. 6 is a schematic view of the top module according to the preferred embodiment of the present invention.
Figure 7:
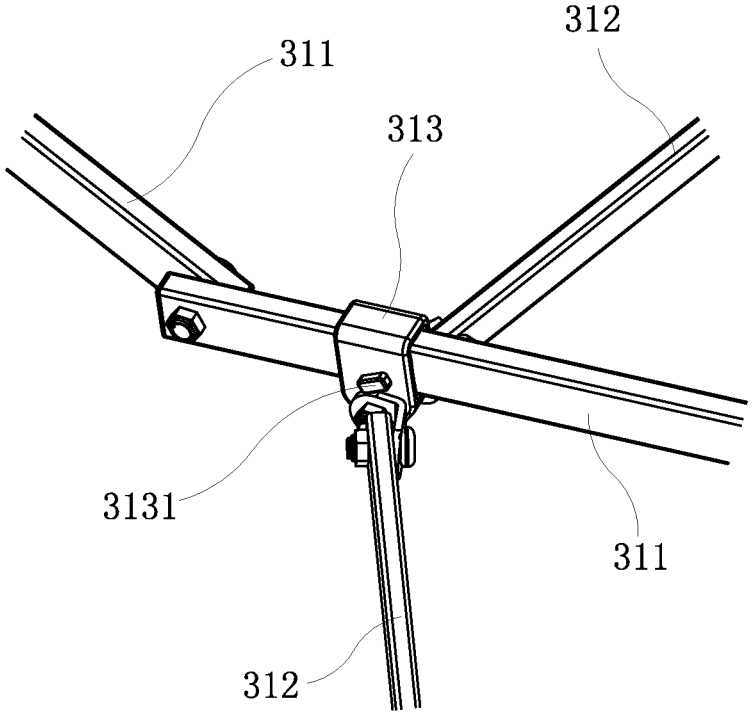
FIG. 7 is a partial enlarged view of circle B in FIG. 3.
Figure 8:
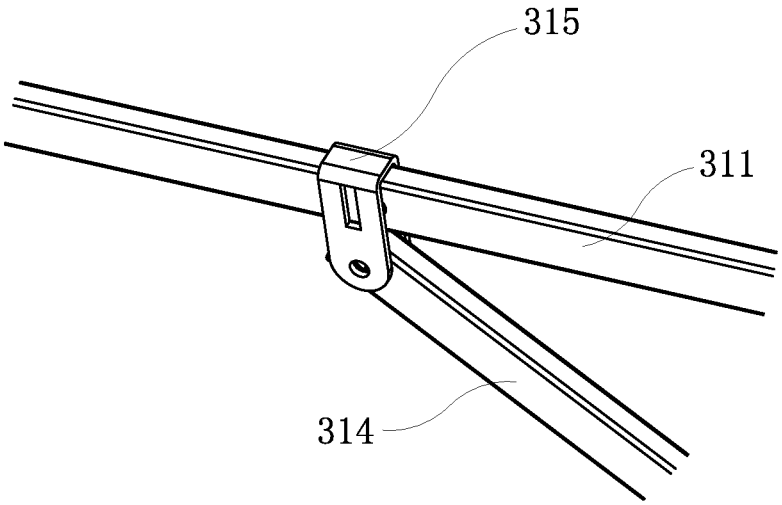
FIG. 8 is a partial enlarged view of circle C in FIG. 3.

Referring to FIG. 1 through FIG. 8, the present invention discloses an improved pole frame structure of a foldable tent. The pole frame structure of the present invention comprises at least three upright poles 1. In this embodiment, the pole frame structure comprises four upright poles 1, which may be composed of six or eight upright poles 1. In order to facilitate the folding and use of the tent, the upright pole 1 may be a telescopic pole. A side support rod unit 2 is pivotally connected between every adjacent two of the upright poles 1 to support the sides of the tent. Each side support rod unit 2 includes at least two side cross support rod assemblies 21. In this embodiment, each side support rod unit 2 includes three side cross support rod assemblies 21. Each side cross support rod assembly 21 includes two crossed side support rods 211 that are pivotally connected. The side cross support rod assemblies 21 are movably connected and positioned on the upright poles 1. When the pole frame structure of the tent is to be folded, the side support rods 211 movably connected to the upright poles 1 of the side cross support rod assemblies 21 slide down, so that the crossed side support rods 211 are folded to realize the folding of the side support rod unit 2.

The top of the pole frame structure of the tent is provided with a top support rod unit 3. The top support rod unit 3 includes at least four top support rod assemblies 31 that are distributed radially. In this embodiment, the top support rod unit 3 includes four top support rod assemblies 31. One end of each top support rod assembly 31 is connected to the upper end of the corresponding upright pole 1 to form a frame for supporting the tent cloth, and the other end is movably connected to a top module 32 to form a tent top. Each top support rod assembly 31 is a rod assembly that can be folded in one direction at its middle, and it is composed of two connecting rods 311 that are pivotally connected. When the tent is folded, while the top support rod unit 3 is folded downward as a whole, the two connecting rods 311 of the top support rod assemblies 31 are folded downward through their pivot portions to drive the upright poles 1 to be retracted inward, in cooperation with the folding of the pole frame structure of the tent.

The adjacent two side support rod units 2 of the adjacent sides of the tent are connected by two connecting blocks 11, 12 arranged on each upright pole 1. The upper connecting block 11 is located at the top end of each upright pole 1. Each support rod assembly 31 is connected to the upper connecting block 11. Two sides of the upper connecting block 11 are respectively connected with the side support rods 211 of the side cross support rod assemblies 21 on the two sides that are close to the upper connecting block 11. The lower connecting block 12 is movably connected and positioned on the upper end of each upright pole 1. Two sides of the lower connecting block 12 are respectively connected with the side support rods 211 that are close to the lower connecting block 12 of the side cross support rod assemblies 21. Moreover, a lock structure is provided on the lower connecting block 12. For folding the tent, the positioning effect of the lower connecting block 12 is released, so that the side support rods 211 that are close to the lower connecting block 12 of the side cross support rod assemblies 21 are moved downward for the side cross support rod assemblies 21 to be folded. An auxiliary support rod 314 is provided under each top support rod assembly 31 for supporting each top support rod assembly 31. An upper end of the auxiliary support rod 314 is pivotally connected to the connecting rods 311 of each top support rod assembly 31, and a lower end of the auxiliary support rod 314 is pivotally connected to the lower connecting block 12. When the pole frame structure of the tent is folded, the auxiliary support rod 314 is folded along with the lower connecting block 12, so as to move the connecting rods 311 of each top support rod assembly 31 to be folded.

Each top support rod assembly 31 is provided with at least one oblique support rod 312. One end of the oblique support rod 312 is pivotally connected to the connecting rods 311 of the top support rod assembly 31, and the other end of the oblique support rod 312 is pivotally connected to the side cross support rod assembly 21 located on either side of the top support rod assembly 31. At least one of the two ends of the oblique support rod 312 is a movable end. In this embodiment, each top support rod assembly 31 is provided with two oblique support rods 312. The two oblique support rods 312 connected to the same top support rod assembly 31 are symmetrical. The two oblique support rods 312 are movably connected to the connecting rods 311 of the top support rod assembly 31. In addition, a slider 313 is provided on the connecting rods 311. The slider 313 is sleeved on the connecting rods 311, and the oblique support rods 312 are pivotally connected to two sides of the slider 313. The two oblique support rods 312 are driven by the slider 313 to move. The other end of each oblique support rod 312 is pivotally connected to the side cross support rod assembly 21, which can be pivotally connected to the intersection of the side cross support rod assemblies 21. Therefore, when the pole frame structure of the tent is folded, the oblique support rods 312 can be folded in conjunction with the folding of the top support rod assembly 31 and the side cross support rod assembly 21.

When the pole frame structure of the tent is to be folded, the positioning effect of the lower connecting block 12 is released, so that the side support rods 211 that are close to the lower connecting block 12 of the side cross support rod assemblies 21 are moved downward for the side cross support rod assemblies 21 to be folded, and the auxiliary support rods 314 each having one end pivoted to the lower connecting block 12 are folded, so as to move the connecting rods 311 of each top support rod assembly 31 to be folded. When the side cross support rod assembly 21 and the top support rod assembly 31 are folded, the oblique support rods 312 are also folded together. Along with the folding of the top support rod assembly 31, the pole frame structure of the tent is further folded. Finally, the pole frame structure of the tent is fully folded to realize the overall folding.

Further, a stopper 3131 is provided on the slider 313. The stopper 3131 is arranged in cooperation with the oblique support rod 312 and is located on the side of the oblique support rod 312 facing the top of the tent. When the tent is unfolded for use, one end of the oblique support rod 312 abuts against the side cross support rod assembly 21, and the other end of the oblique support rod 312 abuts against the top support rod assembly 31 for providing a support function. Besides, one end of the oblique support rod 312, facing the top support rod assembly 31, is blocked by the stopper 3131. The oblique support rod 312 will abut against the stopper 3131 to prevent the end of the oblique support rod 312 pivoted with the top support rod assembly 31 from excessively rotating about the pivot axis to cause the top support rod assembly 31 to sag. As a result, the support height of the oblique support rod 312 to the top support rod assembly 31 is also increased, so that the top of the tent is fully extended, and the tent cloth on the top of the tent is further supported and expanded. The tent cloth is less likely to cause problems such as sag or accumulation of water.

Moreover, because the oblique support rod 312 is supported on one end of the top support rod assembly 31, it will rotate toward one side of the stopper 3131. In a windy situation, the tent cloth may sway up and down due to this rotation, so that the oblique support rod 312 pivotally connected to the top support rod assembly 31 cannot provide a firm support. In addition, the oblique support rod 312 will be higher than the top support rod assembly 31 after rotating about the pivot axis, and will prop up the tent cloth with a raised portion. When the tent cloth is swayed up and down, the end of the oblique support rod 312, facing the tent cloth, will rub the tent cloth repeatedly. After long-term use, the rubbed part of the tent cloth will be damaged due to aging, or it will be directly damaged by the oblique support rod 312. The above-mentioned problem of the pole frame structure of the tent can be solved by providing the stopper 3131 on the slider 313. The stopper 3131 is configured to restrict the oblique support rod 312 pivotally connected to the top support rod assembly 31. The oblique support rod 312 is secured under the stopper 3131 to prevent it from rotating, which makes the support function of the oblique support rod 312 pivotally connected to the top support rod assembly 31 firmer.

Furthermore, when the tent is unfolded for use, the oblique support rod 312 is obliquely supported on one side of the top support rod assembly 31. Therefore, in order to match the inclination angle between the oblique support rod 312 and the top support rod assembly 31 and in order to enhance the firmness of the support of the oblique support rod 312 on the top support rod assembly 31, the stopper 3131 is obliquely arranged on the slider 313. Besides, in order to reduce the production process of the tent and simplify the assembly steps of the tent, the stopper 3131 and the slider 313 may be arranged as an integral structure.

Further, one end of the top module 32, facing the top support rod assembly 31, is provided with a limiting component 321. The upper end face of the top support rod assembly 31 abuts against the lower end face of the limiting component 321 after the pole frame structure of the tent is unfolded. In the process of folding the top support rod assembly 31 close to one side of the top module 32, the connecting rod 311 close to the top module 32 of the top support rod assembly 31 will rotate upward about the pivot axis connected to the top module 32. Through the limiting component 321 provided on the end of the top module 32, facing the top support rod assembly 31, the upper end face of the top support rod assembly 31 abuts against the lower end face of the limiting component 321 after the pole frame structure of the tent is unfolded. The limiting component 321 is configured to restrict the rotation of the connecting rod 311, so that the end of each top support rod assembly 31 close to the center of the tent cannot be deformed downward, thereby enhancing the support of the top of the tent. This makes the support rods on the top of the tent more stable in use, and can prevent the top of the tent from sagging. Further, when the tent cloth is supported and expanded, the tent cloth is less likely to cause problems such as sag or accumulation of water. This increases the beauty of the tent and improves the service life of the tent.

Besides, in order to reduce the production process of the tent and simplify the assembly steps of the tent, the limiting component 321 and the top module 32 may be arranged as an integral structure.

Further, the auxiliary support rod 314 is provided with a connecting component 315. One end of the connecting component 315 is fixedly connected to the top support rod assembly 31, and the other end of the connecting component 315 is pivotally connected to the auxiliary support rod 314. When the pole frame structure of the tent is folded, the auxiliary support rod 314 is folded along with the lower connecting block 12, so as to move the connecting rods 311 of each top support rod assembly 31 to be folded. By providing the connecting component 315, the auxiliary support rod 314 can be attached to the connecting rods 311 of the top support rod assembly 31, so as to prevent the auxiliary support rod 314 from hindering the folding of the connecting rods 311 and causing the pole frame structure of the tent to fail to be folded.

In addition, the connecting component 315 and the top support rod assembly 31 are connected in a sliding manner. In the process of unfolding the pole frame structure of the tent for use, the lower connecting block 12 needs to unfold the top support rod assembly 31 upward through the auxiliary support rod 314. By sliding the connecting component 315 to the top support rod assembly 31, the end of the auxiliary support rod 314, facing the top support rod assembly 31, can slide on the top support rod assembly 31. This makes the unfolding action of the pole frame structure of the tent smooth, and avoids that the pole frame structure of the tent cannot be unfolded smoothly because both ends of the auxiliary support rod 314 are fixedly connected.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An improved pole frame structure of a foldable tent, comprising at least three upright poles and a top support rod unit connected to the upright poles, at least two side cross support rod assemblies being pivotally connected between every adjacent two of the upright poles, the side cross support rod assemblies being movably connected to and positioned on the upright poles, the top support rod unit including a top module, a plurality of top support rod assemblies and oblique support rods, each top support rod assembly having one end connected to an upper end of a corresponding one of the upright poles and another end movably connected to the top module, one end of each oblique support rod being pivotally connected to a corresponding one of the top support rod assemblies through a slider that is sleeved on the corresponding top support rod assembly, another end of each oblique support rod being pivotally connected to a corresponding one of the side cross support rod assemblies located on either side of the corresponding top support rod assembly, wherein a stopper is mounted on the slider in a manner of being arranged in cooperation with a corresponding one of the oblique support rods and facing one side of the corresponding oblique support rod facing a top of the tent, and wherein one end of the top module, which faces the top support rod assemblies, is provided with a limiting component, an upper end face of each top support rod assembly abutting against a lower end face of the limiting component after the pole frame structure is unfolded, wherein the slider is slidably mounted on the corresponding top support rod assembly at a location separated from the top module that is pivotally connected to one end of the top support rod assembly, and wherein the stopper that is mounted on the slider and the limiting component that is provided on the top module are spaced from each other along the top support rod assembly.

2. The improved pole frame structure of the foldable tent as claimed in claim 1, wherein the limiting component is integrally formed with the top module.

3. The improved pole frame structure of the foldable tent as claimed in claim 1, wherein the stopper is obliquely arranged on the slider.

4. The improved pole frame structure of the foldable tent as claimed in claim 3, wherein the stopper is integrally formed with the slider.

5. The improved pole frame structure of the foldable tent as claimed in claim 1, wherein an auxiliary support rod is provided under each top support rod assembly for supporting each top support rod assembly, an upper end of the auxiliary support rod is pivotally connected to a connecting rod of each top support rod assembly, and a lower end of the auxiliary support rod is pivotally connected to a lower connecting block.

6. The improved pole frame structure of the foldable tent as claimed in claim 5, wherein the auxiliary support rod is provided with a connecting component, one end of the connecting component is fixedly connected to the corresponding top support rod assembly, and another end of the connecting component is pivotally connected to the auxiliary support rod.

7. The improved pole frame structure of the foldable tent as claimed in claim 5, wherein the auxiliary support rod is provided with a connecting component, one end of the connecting component is connected to the corresponding top support rod assembly in a sliding manner, and another end of the connecting component is pivotally connected to the auxiliary support rod.

* * * * *